United States Patent [19]

Mangone

[11] Patent Number: 4,623,209

[45] Date of Patent: Nov. 18, 1986

[54] SAFETY FEMALE PLUG CONNECTOR

[76] Inventor: Domingo Mangone, Soldado Baigorria 1456, Grand Bourg, Pcia.de Buenos Aires, Argentina

[21] Appl. No.: 718,544

[22] Filed: Apr. 1, 1985

[30] Foreign Application Priority Data

Apr. 9, 1984 [AR] Argentina ..... 296237

[51] Int. Cl.[4] ..... H01R 13/631

[52] U.S. Cl. ..... 339/75 P; 339/111

[58] Field of Search ..... 339/75 R, 75 M, 75 P, 339/111; 200/51.09

[56] References Cited

U.S. PATENT DOCUMENTS

| | | | |
|---|---|---|---|
| 2,735,906 | 2/1956 | Avrunin | 200/51.09 |
| 3,980,370 | 9/1976 | Gonzalez-Hernandez | 200/51.09 |
| 4,179,175 | 12/1979 | Farnworth et al. | 200/51.09 |

FOREIGN PATENT DOCUMENTS

| | | | |
|---|---|---|---|
| 2030264 | 12/1971 | Fed. Rep. of Germany | 339/111 |
| 2119256 | 11/1972 | Fed. Rep. of Germany | 339/111 |
| 1304161 | 10/1962 | France | 200/51.09 |
| 370826 | 9/1963 | Switzerland | 200/51.09 |

*Primary Examiner*—John McQuade
*Attorney, Agent, or Firm*—Marvin E. Jacobs

[57] ABSTRACT

The safety socket of this invention is characterized in that each insertion opening is tapered from its mouth inwards and, in each case, is defined by a fixed part whose face defining the insertion opening is substantially parallel to the direction of insertion, and by swinging part, one of the parts defining an insertion opening being made of electrically conductive material and the other one being made of insulating material; in each case, adjacent to the parts made of conductive material and outside of the insertion opening, a resilient contact tongue, flexible transversally to the direction of insertion, is rigidly mounted at one end to the insulating casing and is electrically connected to the respective connection terminal; and, in each case, the swinging part of an insertion opening is kinematically connected by means of a stirrup or connecting rod with the resilient contact tongue corresponding to at least another insertion opening.

6 Claims, 11 Drawing Figures

SAFETY FEMALE PLUG CONNECTOR

BACKGROUND OF THE INVENTION

This invention relates to a safety socket having an insulating casing with at least two insertion openings for the pins of a plug, the openings each containing a contact piece electrically connected to an outer connection terminal.

Some of the already known types of safety sockets are provided with a restraining device at the mouth of the insertion openings. One of them has at its front face a slide having two circular holes spaced at the same distance as the spacing between the pins of the plug. The said slide is resiliently biased by a spring towards a position in which the said circular holes and the insertion opening of the socket itself are not aligned, thus making it impossible to insert the pins of the plug. In order to insert these pins, the slide must be moved so as to align the holes with the insertion openings. If a person, particularly a child, moves the slide with his hand and inserts a metallic object he risks electrocution.

Other safety sockets are provided at the mouths of the insertion openings with little oscillating lugs in locking engagement, which can be unlocked only by the simultaneous insertion of the pins of a plug. Although offering more safety than the sockets mentioned in the first place, a person plugging in a plug with one finger inadvertently placed on a pin risks receiving an electric shock.

The object of this invention is to avoid these drawbacks and to provide a completely foolproof safety socket.

The invention achieves its object by providing a safety socket of the type mentioned at the beginning of this specification, characterized in that each insertion opening is tapered from its mouth inwards and, in each case, is defined by a fixed part whose face defining the insertion opening is substantially parallel to the direction of insertion, and by a swinging part, one of the parts defining an insertion opening being made of electrically conductive material and the other one being made of insulating material; in each case, adjacent to the parts made of conductive material and outside of the insertion opening, a resilient contact tongue, flexible transversally to the direction of insertion, is rigidly mounted at one end to the insulating casing and is electrically connected to the respective connection terminal; and, in each case, the swinging part of an insertion opening is kinematically connected by means of a stirrup or connecting rod with the resilient contact tongue corresponding to at least another insertion opening.

With the socket of this invention, when inserting only one pin or any metallic object, such as e.g. a nail, the swinging movement of the corresponding swinging part causes the electric connection of the contact piece in the other insertion opening.

The arrangement of this invention may be applied also to single-phase earthed sockets, three-phase sockets, sockets for plugs with cylindrical pins, sockets for plugs with plane pins, and combination sockets.

This invention will now be described with reference to several embodiments illustrated in the annexed drawings, in which:

FIG. 6 is a sectional side view of the socket of FIG. 4 with a plug having cylindrical pins completely plugged-in.

FIG. 8 is a sectional side view of the socket of FIG. 7, with a plug completely plugged-in.

DESCRIPTION OF THE VARIOUS EMBODIMENTS

Figure 1:
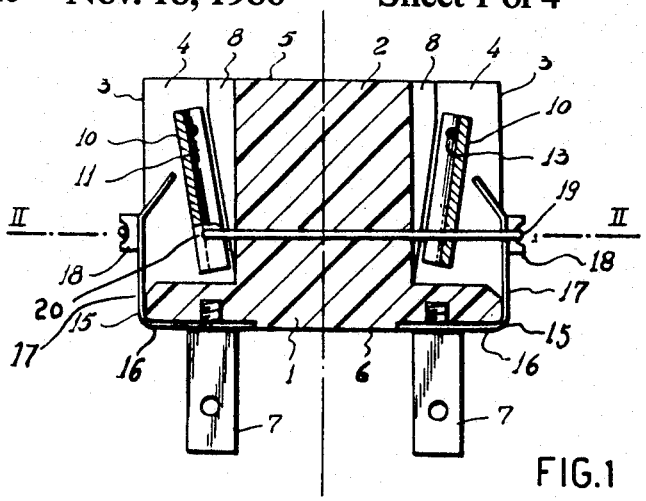
FIG. 1 is a sectional side view of a first embodiment of the safety socket for plugs with cylindrical pins.
Figure 2:
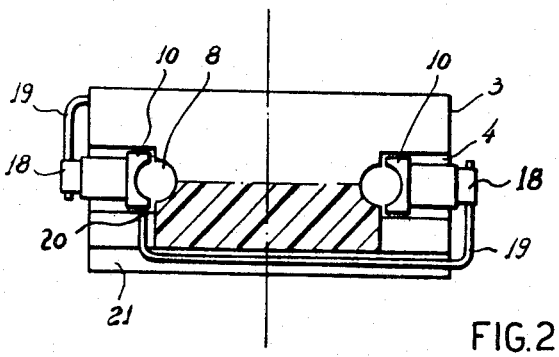
FIG. 2 is a plan view of FIG. 1.
Figure 3:
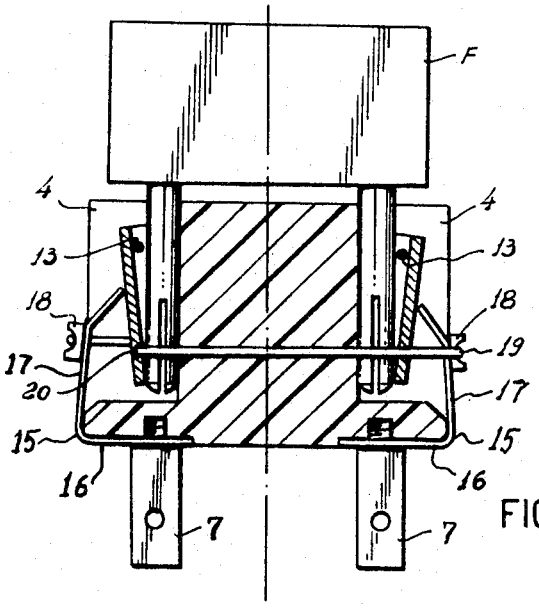
FIG. 3 shows the socket of FIG. 1 with a plugged-in plug.

The socket 1 of the first embodiment shown in FIGS. 1 to 3 has a casing 2 made of insulating material, substantially shaped like a rectangular parallelepiped, having on its smaller side faces 3 in each case a slot 4, i.e. a U-shaped slot extending from the upper face 5 (i.e. the face through which the pins of the plug are inserted) to a point near the lower face 6, provided with two conventional connection terminals 7. Each of these U-shaped slots 4 has at its innermost face (or bottom) a half-round groove 8, i.e. a groove with a semicircular section, whose radius is slightly bigger than the radius of the pins of the plug "F"; the width of slot 4 being bigger than the diameter of groove 8.

In each of the slots 4 of the insulating casing 2 a swinging part 10 made of electrically conductive material is revolvingly mounted, shaped like a rectangular prism with a half-round groove 11 in the face facing the bottom of slot 4 of casing 2. The radius of the half-round groove 11 is the same as the radius of the half-round groove of slot 4 of casing 2, the swinging part 10 being revolvingly mounted at its upper end by means of a pivot pin 13 so that at the level of said pivot pins 13 the contours of both half-round grooves 8 and 11 are situated on the same circumference.

The socket 1 has also two L-shaped resilient tongues 15 made of conductive material and mounted so that one leg 16 rests on the lower face 6 of insulating casing 2 and is fixed by the corresponding connection terminal 7; the other leg 17, whose free end is bent in an acute angle inside the respective slot 4 of casing 2, extends laterally along the smaller side face of casing 2. A little bearing rest 18 made of insulating material is fixed in each case to the free leg 17 of each resilient tongue 15 by the outer part adjacent to the bent free end.

Finally, the socket 1 is provided with two stirrups 19 made of steel wire and U-shaped in this embodiment. In each case, these stirrups connect kinematically (but not electrically) the lower free end of one of the swinging parts 10, provided for such purpose with a bearing hole 20, with the resilient free leg 16 of the contact tongue 15 adjacent to the other swinging part 10. In order to establish this connection, a bent end of the respective stirrup is inserted in said hole 20 of a swinging part, and the other bent end of the stirrup is hooked into the bearing rest 18 of insulating material of the opposite contact tongue. In order to protect the stirrups 19 electrically and mechanically, they are slidingly housed in transversal slots 21 provided in the bigger side faces of casing 2.

The length of the stirrups 19 is such that the swinging part 10 and the bottom of slot 4 of casing 2 define an insertion opening that tapers inwards in a wedge-shaped way.

The arrangement and configuration of the different parts of the socket are such that in the unplugged socket the swinging parts 10 show a certain clearance as regards the bent free ends of the adjacent contact tongues 15, said swinging parts 10 thus being electrically insulated from the corresponding contact tongues electrically connected to the respective connection terminals 7. Only when a plug is plugged in and the pins are inserted relatively deeply, i.e. in a position in which it is impossible to touch accidentally a pin, the respective swinging parts are pushed towards the outside by the pins, and through the bent stirrups the resilient contact tongues are pushed towards the inside of slot 4 until the said resilient tongues make contact under pressure with the adjacent swinging parts, thus closing in each case an electric circuit from the connecting terminal 7 through the resilient contact tongue 15 and the swinging part 10 to the pin of plug "F".

Figure 4:
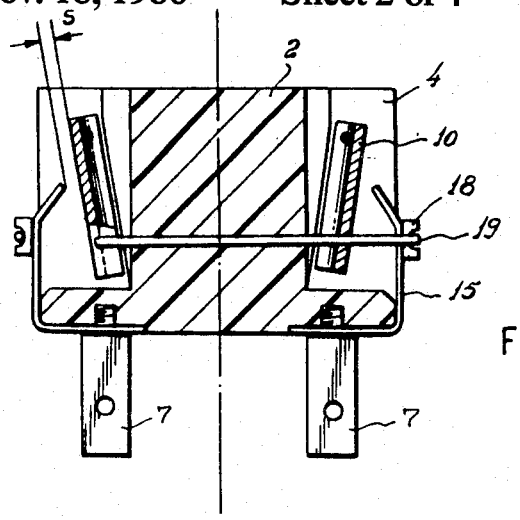
FIG. 4 is a sectional side view of a second embodiment of a socket for plugs with cylindrical pins.
Figure 5:
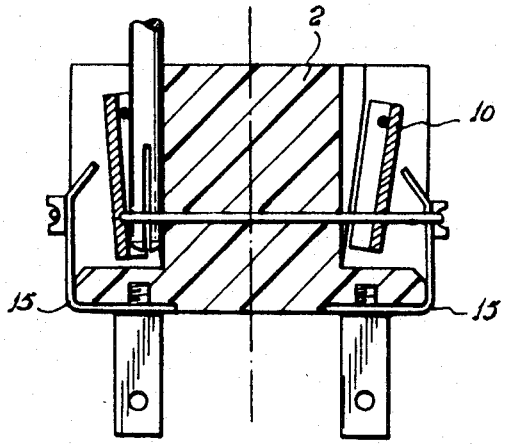
FIG. 5 is a sectional side view of the socket of FIG. 4 with only one pin inserted.
Figure 6:
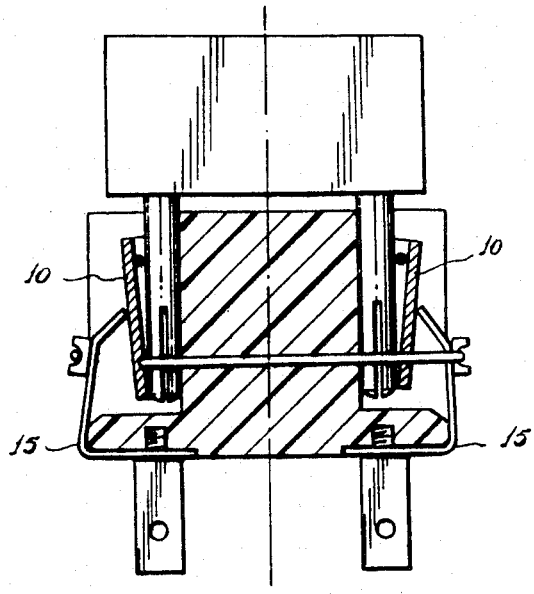

The second embodiment of the socket, shown in FIGS. 4 to 6, is different from the first embodiment because the spacing S (FIG. 4) is bigger in this latter case. Thus, when only one pin or some other similar metallic object is inserted in one of the wedge-shaped insertion openings of the socket, the swinging piece 10 takes up a position approximately parallel to the pin or metallic object inserted, without making contact with the adjacent resilient contact tongue 15. Only when inserting jointly two pins, said adjacent resilient tongue 15 is bent inwards of the slot by its stirrup 19, due to the swinging movement of the other swinging piece 10, thus closing the electric circuit.

It is understood that these two embodiments are not limited to sockets for plugs with cylindrical pins, but can also be adapted, with some slight modifications, to plugs with plane pins of the "110 volt" type.

Figure 7:
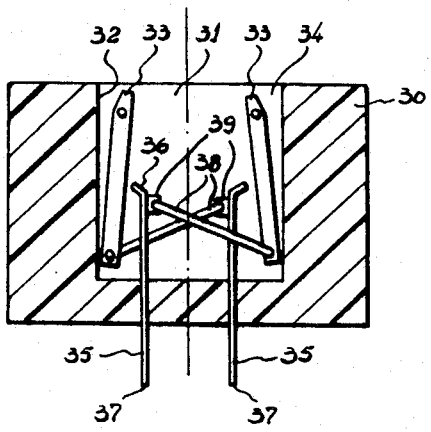
FIG. 7 is a sectional side view of a third embodiment of the socket of this invention, for plugs with two plane pins.
Figure 8:
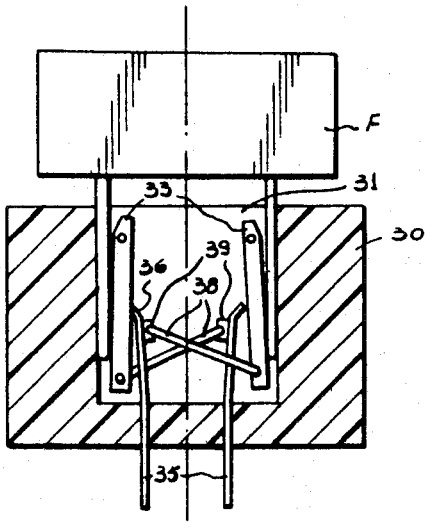

The third embodiment, shown in FIGS. 7 and 8, is particularly suitable for plugs with plane pins. In this case, the casing 30 made of insulating material has a central prismatic rectangular cavity 31, open through the upper face of the casing (i.e. the face of the socket). The inner smaller side faces 32 of said cavity are plane and parallel to the direction of insertion. Inside said cavity are revolvingly mounted by their upper ends two swinging parts 33 having a planar prismatic rectangular configuration. The smaller side faces 32 and the swinging parts 33 define between them in each case a wedge-shaped insertion opening 34. Both insertion openings are separated from each other by a spacing corresponding to the spacing between the pins of the corresponding plug. On the lower face of the cavity the insulating casing is provided with two resilient contact tongues 35 in the form of lamellae disposed approximately parallel to the direction of insertion, whose inner free ends are bent towards the respective adjacent swinging parts. The outer ends 37 of said resilient lamellae or contact tongues 35 are provided with, or connected to, connection terminals (not shown). According to this invention, one of the swinging contact parts 33 is kinematecally connected in each case to the resilient contact tongue of the opposite side by means of a connecting rod 38 whose mechanical function is the same as that of the stirrups of the first two embodiments, except that the connecting rods 38 operate by compression. In order to insulate electrically the respective connecting rods from the resilient contact tongues, the latter are provided in each case with a small bearing rest 39 made of insulating material. Instead of providing these bearing rests 39 it would also be possible to provide a connecting rod made of insulating material. As shown in FIG. 7, in the unplugged position there is a clearing between the swinging parts 33 and the free ends of the adjacent resilient contact tongues 35; thus the swinging parts remain electrically disconnected. When the plane pins of a "110 volt" type plug are inserted in the wedge-shaped insertion openings 34, the swinging parts take up a position approximately parallel to the pins, pushing by means of the respective connecting rods the opposite resilient tongues against the adjacent swinging part, thus closing the clearing between the swinging part and the adjacent resilient tongue (FIG. 8).

Figure 9:
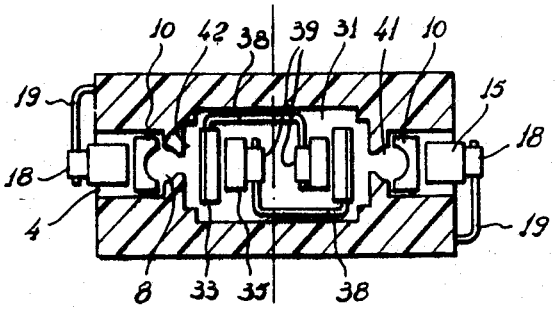
FIG. 9 is a plan view of a fourth embodiment of a combination type socket, i.e. a socket for plugs having cylindrical pins and plugs having plane pins.

In a fourth embodiment the invention has been applied to a combination socket for plugs with cylindrical pins and plugs with plane pins; this socket is shown in the plan view of FIG. 9. This embodiment is really a combination of the embodiment of FIGS. 1 to 3 and the embodiment of FIGS. 7 and 8.

For plugs with cylindrical pins two wedge-shaped approximately conical insertion openings 41 are provided, defined in each case by an outer swinging part 10 and by a half-round groove provided in the bottom of a slot 4 in the insulating casing. For plugs with plane pins, on the other hand, are provided two wedge-shaped openings 42 defined in each case by a smaller side wall of a cavity 31 and an inner swinging part 33. Due to the plugs at present in use, the half-round groove is interrupted towards the inner cavity 31. This combination socket has also outer resilient contact tongues 15 kinematically and alternatively connected by means of stirrups 19 and insulating bearing rests 18 with the opposite outer swinging parts 10; it also has resilient inner tongues 35, kinematically and alternatively connected by means of connecting rods 38 and insulating bearing rests 39 with the opposite inner swinging parts 33.

Figure 10:
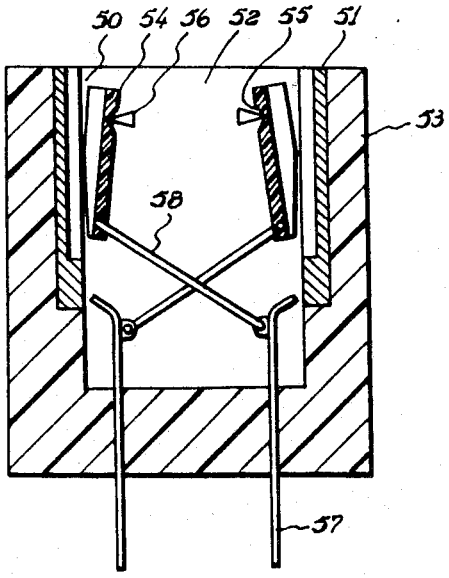
FIG. 10 is a sectional side view of a fifth embodiment of the socket according to this invention.

FIG. 10 shows a fifth embodiment of a socket for plugs having cylindrical pins. In this embodiment, the tapered insertion openings 50 are formed in each case by a fixed metallic contact part 51 inlaid in the corresponding smaller side face of a prismatic inner cavity 52 of the insulating casing 53, and by a swinging part 54 made of insulating material, swingably mounted by its upper end. In this case, the centre of rotation does not consist of a pivot pin but of a notch 55 in the swinging part and a knife edge 56 integral with the insulating casing 53, the swinging parts being biased towards the respective knife edges by resilient means (not shown).

Two resilient contact tongues 57 are provided in the lower part of the casing, and the free ends of these contact tongues are bent in each case towards said fixed metallic part 51, there being a certain clearing between them. As shown in FIG. 10, in this case too the insulating swinging parts 54 are kinematically connected by means of connecting rods 58 to the respective opposite resilient contact tongues 57.

Figure 11:
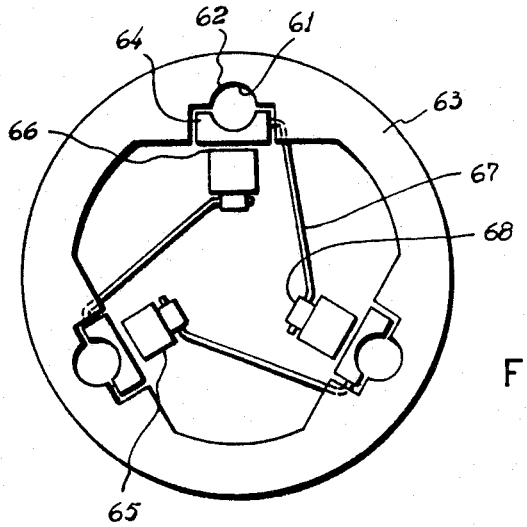
FIG. 11 is a plan view of a sixth embodiment, in this case of a three-phase socket.

FIG. 11 shows a sixth embodiment of a three-phase socket for plugs having cylindrical pins. Each tapered insertion opening 61 is formed by a half-round groove 62 provided inside the casing, and by a swinging contact part 64; the grooves 62 are uniformly distributed in the insulating casing 63. Radially inwards, as regards the swinging part, there has been provided in each case a resilient contact tongue 65 whose free end 66 is bent towards the lower end of the swinging part, there being a certain clearing between them. In a given direction of rotation each swinging part is kinematically connected by means of a connecting rod 67 and a small bearing rest 68 with the resilient contact tongue adjacent to the following swinging part.

It is understood that the swinging parts and the resilient contact tongues may also be arranged on the outside, in contrast to the arrangement shown in FIG. 11. In fact, the invention is not limited to three-phase sockets for plugs with cylindrical pins and uniformly distributed at 120°, but may be applied also to sockets for plugs having plane pins irregularly distributed.

Having thus particularly ascertained and described the nature of the present invention and how the same may be put into practice, what I claim as my invention and exclusive property is:

1. A female safety socket, comprising an insulating casing with at least two insertion openings each extending into the casing from a mouth for the pins of a male plug, each of the insertion openings being provided inside the casing with a contact piece electrically connected to a connection terminal outside the casing adapted for connection to an electrical wire thereto; CHARACTERIZED in that:

(a) each insertion opening is tapered from the insertion mouth inwards and is bounded along one side by a fixed piece substantially parallel to the direction of insertion and bounded along another side opposite said one side by a swinging piece hinged adjacent the mouth, one of said two pieces bounding the sides of said insertion opening being made of electrically conductive material and the other being made of insulating material;

(b) resilient contact tongues, flexible transversely to the direction of insertion, disposed adjacent to respective ones of the electrically conductive pieces within the insulating casing but outside of the insertion openings, said contact tongues each being mounted at one end rigidly to the insulating casing and being electrically connected with said respective connection terminal; and, (c) connecting member connecting said swinging pieces for respective ones of the insertion openings to said contact tongue for the other insertion opening whereby as a male plug pin is inserted into one of the insertion openings said connecting member attached to said swinging piece disposed therein moves said contact tongue for the other insertion opening into electrical contact with said electrically conductive material bounding the other insertion opening thereby making electrical contact with a male plug pin disposed therein.

2. A female safety socket according to claim 1, CHARACTERIZED in that:

(a) said swinging pieces are said pieces made of conductive material;

(b) the end of each resilient contact tongue not mounted to said casing is disposed with a clearance in the unplugged position with respect to the adjacent said swinging piece; and, (c) said members are adapted to pull on said resilient contact tongues and electrically insulated traction stirrups are disposed in the connection of said members to said resilient contact tongues whereby electrical shorting between the male plug pins by said members is prevented.

3. A female safety socket according to claim 1, CHARACTERIZED in that:

(a) said swinging pieces are said pieces made of conductive material;

(b) the end of each resilient contact tongue not mounted to said casing is disposed with a clearance in the unplugged position with respect to the adjacent said swinging piece; and, (c) said members are thrust rods adapted to push said resilient contact tongues and electrically insulated portions are disposed in the connection of said rods to said resilient contact tongues whereby electrical shorting between the male plug pins by said rods is prevented.

4. A female safety socket according to claim 1, CHARACTERIZED in that:

(a) said swinging pieces are said pieces made of insulating material;

(b) the end of each resilient contact tongue not mounted to said casing is disposed with a clearance in the unplugged position with respect to the adjacent said fixed piece of conductive material and underneath the respective insertion opening; and, (c) said swinging pieces and said resilient contact tongues are connected through thrust connecting rods.

5. A female safety socket according to claim 1, CHARACTERIZED by having two pairs of adjacent insertion openings wherein:

(a) each pair of insertion openings is separated by a longitudinal transverse wall of insulating material;

(b) each pair of insertion openings has an outer swinging piece made of conductive material, an inner swinging piece made of conductive material an outer resilient contact tongue having a free end disposed with a clearance with respect to the adjacent said outer swinging piece, and an inner resilient contact tongue having a free end disposed with a clearance with respect to the adjacent said inner swinging piece; and wherein, (c) said outer swinging pieces and said outer resilient contact tongues are connected by means of stirrups to employ a pulling force in their operation, and said inner swinging pieces and said inner resilient contact tongues are connected by means of connecting rods to employ a pushing force in their operation.

6. A female safety socket according to claim 1, CHARACTERIZED by having three insertion openings and wherein:

(a) said swinging piece of each insertion opening is operably connected by said member thereof to said flexible contact tongue of the subsequent said insertion opening in a given direction of rotation.

* * * * *